US010399821B2

(12) United States Patent
Roberts

(10) Patent No.: US 10,399,821 B2
(45) Date of Patent: Sep. 3, 2019

(54) VIBRATION-BASED ELEVATOR TENSION MEMBER WEAR AND LIFE MONITORING SYSTEM

(71) Applicant: Otis Elevator Company, Farmington, CT (US)

(72) Inventor: Randall Keith Roberts, Hebron, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/509,876

(22) PCT Filed: Sep. 9, 2015

(86) PCT No.: PCT/US2015/049143

§ 371 (c)(1),
(2) Date: Mar. 9, 2017

(87) PCT Pub. No.: WO2016/040452

PCT Pub. Date: Mar. 17, 2016

(65) Prior Publication Data

US 2017/0247226 A1 Aug. 31, 2017

Related U.S. Application Data

(60) Provisional application No. 62/048,854, filed on Sep. 11, 2014.

(51) Int. Cl.
*B66B 1/34* (2006.01)
*B66B 3/00* (2006.01)
(Continued)

(52) U.S. Cl.
CPC ..... *B66B 7/1215* (2013.01); *B66B 5/0025* (2013.01); *B66B 5/0031* (2013.01); *B66B 9/00* (2013.01)

(58) Field of Classification Search
CPC . B66B 7/1215; B66B 5/00255; B66B 5/0031; B66B 9/00
(Continued)

(56) References Cited

U.S. PATENT DOCUMENTS 4,979,125 A 12/1990 Kwun et al.
5,456,113 A * 10/1995 Kwun ..... G01N 29/14 73/587
(Continued)

FOREIGN PATENT DOCUMENTS

CN 102020149 A 4/2011
CN 202988463 U 6/2013
(Continued)

OTHER PUBLICATIONS

International Search Report and Written Opinion for application PCT/US2015/049143, dated Nov. 20, 2015, 13pgs.
(Continued)

*Primary Examiner* — Jeffrey Donels
(74) *Attorney, Agent, or Firm* — Cantor Colburn LLP

(57) ABSTRACT

An elevator system (100) includes an elevator drive system (101) including a tension member (103) supporting an elevator car (106) under tension and a monitoring system (102). The monitoring system includes a vibration sensor (111) for detecting vibration of at least one of the tension member and the elevator car and an analysis unit (112) for determining a level of wear and life of the tension member based on the vibration of the tension member detected by the vibration sensor.

12 Claims, 7 Drawing Sheets

(51) Int. Cl.
*B66B 7/12* (2006.01)
*B66B 5/00* (2006.01)
*B66B 9/00* (2006.01)

(58) Field of Classification Search
USPC ..... 187/393
See application file for complete search history.

(56) References Cited

U.S. PATENT DOCUMENTS

| | | | | |
|---|---|---|---|---|
| 5,731,528 | A | 3/1998 | Yamazaki et al. | |
| 5,834,942 | A | 11/1998 | De Angelis | |
| 5,877,431 | A | 3/1999 | Hirano | |
| 6,450,036 | B1 * | 9/2002 | Ashida | G01N 29/043 73/584 |
| 6,662,660 | B2 * | 12/2003 | Smith | B66B 7/1215 324/535 |
| 6,923,065 | B2 * | 8/2005 | Smith | B66B 7/1215 324/535 |
| 8,851,239 | B2 * | 10/2014 | Nakamori | B66B 7/1215 187/393 |
| 2004/0099062 | A1 * | 5/2004 | Smith | B66B 7/1215 73/801 |
| 2005/0274197 | A1 | 12/2005 | Le | |
| 2009/0303065 | A1 | 12/2009 | Lipowski | |
| 2012/0031187 | A1 | 2/2012 | Bohn et al. | |
| 2014/0027209 | A1 | 1/2014 | Kallioniemi et al. | |
| 2014/0027401 | A1 | 1/2014 | Ilaka et al. | |
| 2014/0109682 | A1 | 4/2014 | Mupdende et al. | |

FOREIGN PATENT DOCUMENTS

| | | | |
|---|---|---|---|
| CN | 103204416 | A | 7/2013 |
| CN | 105164039 | A | 12/2015 |
| JP | H07172763 | A | 7/1995 |
| JP | 2001192183 | A | 7/2001 |
| JP | 2002267556 | A | 9/2002 |
| WO | 2005040028 | A1 | 5/2005 |
| WO | 2013079530 | A1 | 6/2013 |
| WO | 2013110312 | A1 | 8/2013 |

OTHER PUBLICATIONS

Lyamin, G.S. et al., "Equipment for control of force distribution between the ropes of multirope hoisting systems", abstract, Ugol' Ukr.; (Ukrainian SSR); Journal vol. 12, Aug. 1, 1982, available at: https://www.etde.org/etdeweb/details.jsp?query_id=0&page=0&osti_id=5148440&Row=0, 1 pg.

Raisutis, Renaldas, et al., "Ultrasonic guided wave-based testing technique for inspection of multi-wre rope structures", NDT & E International, Butterworth-Heinemann, vol. 62, Dec. 1, 2013, 10 pages.

Chinese First Office Action for application CN 201580051468.6, dated Sep. 27, 2018, 12 pages.

* cited by examiner

VIBRATION-BASED ELEVATOR TENSION MEMBER WEAR AND LIFE MONITORING SYSTEM

BACKGROUND OF THE INVENTION

Embodiments of the invention relate to elevators, and in particular to the vibration-based wear and life monitoring of elevator tension members.

Elevator systems typically utilize tension members, such as ropes, belts, bands, or cables, to propel an elevator car along a hoistway. One type of tension member is a coated steel belt which may be made up of multiple wires located within a jacket material. During normal elevator operation, tension members are subjected to a large number of bending cycles as the tension member travels over drive sheaves and deflector sheaves of the elevator system. In addition, over time, the weight of the elevator car on the tension member may result in stretching of the tension member, which may result in fatigue, such as the creation of micro-cracks in the tension member. Such fatigue is a major contributor to reduction in service life of the tension member. While the service life of tension members can be estimated through calculation, a more accurate estimation of remaining life of the coated steel tension member is often obtained by utilizing a life-monitoring system.

One such system is called resistance-based inspection (RBI). An RBI system monitors an electrical resistance of each cord in the tension member. Some cord configurations, however, do not exhibit a significant, measurable change in resistance which can be correlated to a number of bending cycles or cord degradation. In such cases, assessment of tension member condition based upon changes in electrical resistance of the cords is difficult due to the small magnitude of change in electrical resistance of the cords as the cords wear.

BRIEF DESCRIPTION OF THE INVENTION

Embodiments of the present invention include an elevator system. The system may include an elevator drive system including a tension member supporting an elevator car under tension and a wear and life monitoring system. The wear and life monitoring system may include a vibration sensor for detecting vibration of at least one of the tension members and the elevator car and a wear and life analysis unit for determining a level of wear and life of the tension member based on the vibration of the tension member detected by the vibration sensor.

In one embodiment, the vibration sensor may detect a vibration of the elevator car, and the wear and life analysis unit may determine the level of wear and life of the tension member based on the vibration of the elevator car.

In the above embodiments, or in the alternative, the vibration sensor may detect a vibration of the tension member directly, and the wear and life analysis unit may determine the level of wear and life of the tension member based on the vibration of the tension member.

In the above embodiments, or in the alternative, the vibration sensor may detect a vibration of the tension member by detecting a vibration of one or more tension member guiding elements, and the wear and life analysis unit may determine the level of wear and life of the tension member based on the vibration of the tension member guiding elements.

In the above embodiments, or in the alternative, the vibration sensor may include an accelerometer connected to one of the elevator car and a tension member-guiding element for detecting the vibration of the elevator car and the tension member-guiding element, respectively.

In the above embodiments, or in the alternative, the vibration sensor may be configured to detect a longitudinal vibration of the tension member.

In the above embodiments, or in the alternative, the wear and life analysis unit may be configured to determine the level of wear and life of the tension member by performing a spectral analysis of the vibration detected and measuring a level of frequency shift of the detected vibration relative to a reference frequency spectrum.

In the above embodiments, or in the alternative, the wear and life analysis unit may be configured to determine the level of wear and life of the tension member by determining an elastic modulus of the tension member.

In the above embodiments, or in the alternative, a vibration inducing element creates the vibration of at least one of the tension member and the elevator car.

According to another embodiment of the invention, a method of determining a level of wear and life of a tension member supporting a load includes detecting a vibration of one of an elevator car and a tension member supporting the elevator car and determining a level of wear and life of the tension member based on the detected vibration.

In the above embodiment, determining the level of wear and life of the tension member may include determining the modulus of elasticity of the tension member based on the detected vibration.

In the above embodiments, or in the alternative, detecting the vibration of one of the elevator car and the tension member supporting the elevator car may include detecting the vibration of the elevator car, and determining the level of wear and life of the tension member based on the detected vibration may include determining the level of wear and life of the tension member based on the vibration of the elevator car.

In the above embodiments, or in the alternative, detecting the vibration of one of the elevator car and the tension member supporting the elevator car may include detecting the vibration of the tension member directly, and determining the level of wear and life of the tension member based on the detected vibration may include determining the level of wear and life of the tension member based on the vibration of the tension member.

In the above embodiments, or in the alternative, detecting the vibration of one of the elevator car and the tension member supporting the elevator car may include detecting the vibration of one or more tension member guiding elements, and determining the level of wear and life of the tension member based on the detected vibration may include determining the level of wear and life of the tension member based on the vibration of the one or more tension member guiding elements.

In the above embodiments, or in the alternative, detecting the vibration of one of the elevator car and the tension member supporting the elevator car may include detecting a longitudinal vibration of the tension member.

In the above embodiments, or in the alternative, determining the level of wear and life of the tension member based on the detected vibration may include performing a spectral analysis of the vibration detected and measuring a level of frequency shift of the detected vibration relative to a reference frequency spectrum.

According to another embodiment of the invention, a tension member wear and life detection system includes one or more sensors to detect a vibration of at least one of an elevator car and a tension member supporting the elevator car and a wear and life analysis unit for determining a level of wear and life of the tension member based on the vibration of the tension member detected by the one or more sensors.

In the above embodiment, the one or more sensors may be configured to detect a longitudinal vibration of the tension member.

In the above embodiments, or in the alternative, the one or more sensors may be configured to detect a car vibration of the elevator car.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Tension members in elevator systems are subject to wear, and high levels of wear may result in accidents or other breakdowns in the system. Embodiments of the invention relate to determining the wear and life of a tension member in an elevator system by measuring a vibration of the tension member or of an elevator car supported by the tension member. Embodiments include a system that offers wear and life prediction capability by using a vibration-based system that can be applied on a large variety of elevator tension members.

Figure 1:
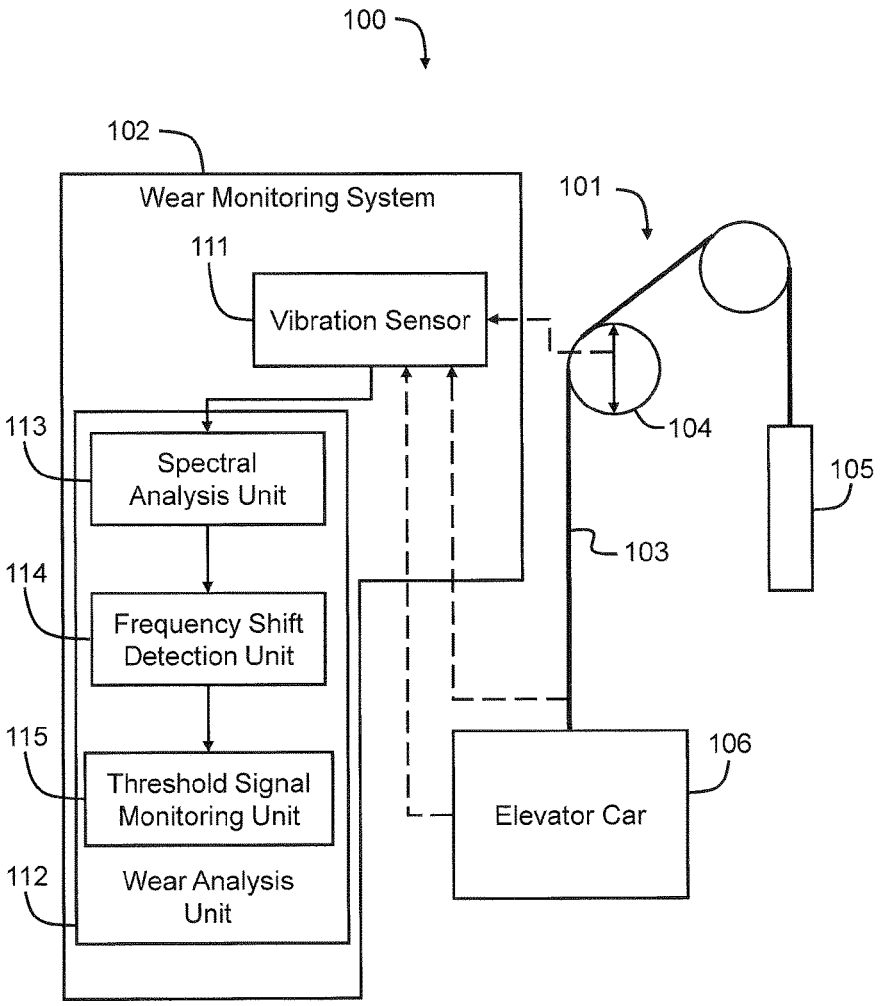
FIG. 1 illustrates an elevator system according to an embodiment of the invention.
Figure 2:
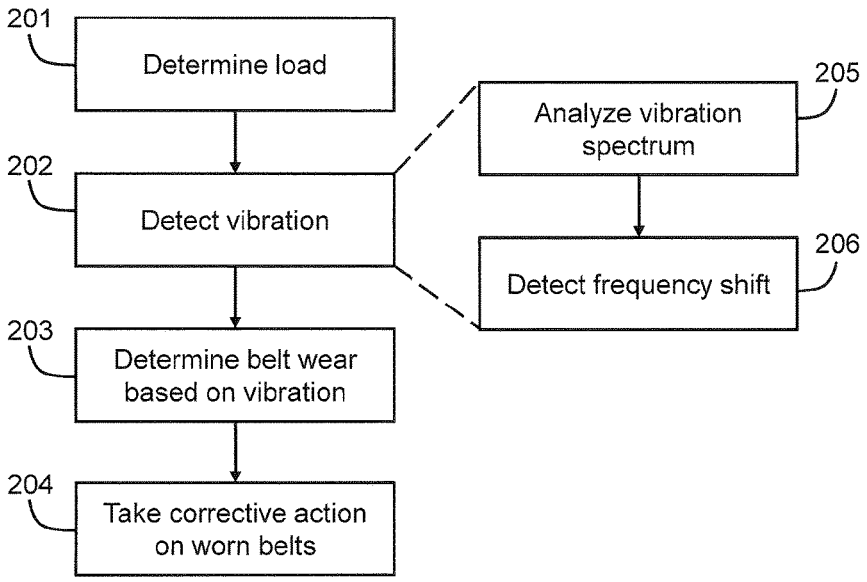
FIG. 2 is a flow diagram of a method according to an embodiment of the invention.

FIG. 1 illustrates an elevator system 100 according to an embodiment of the invention. FIG. 2 is a flow diagram of a method according to an embodiment of the invention. The system 100 includes elevator drive system 101 and a tension member wear and life detection system 102. The elevator drive system 101 includes a tension member 103, which may also be referred to as a cable, band, belt, or rope. The tension member 103 supports the weight of an elevator car 106. The tension member 103 may be made of any material sufficiently strong to support a predetermined weight, including the weight of the elevator car 106. Examples of materials that may make up the tension member 103 include steel cables and carbon fibers, but embodiments are not limited to these materials.

The elevator drive system 101 further includes tension member guiding elements 104 and a counterweight 105. Tension member guiding elements 104 include any elements that affect a path of the tension member 103 and may include drive elements that drive the tension member 103 and passive elements that change or manage a path of the tension member 103. Examples of tension member guiding elements 104 include shafts, rollers, gears, drive sheaves, deflector sheaves or any other elements that vibrate or have other characteristics that are changed based on a vibration of the tension member 103. For example, the tension member guiding element pointed to by the reference numeral 104 may vibrate based on the vibration of the tension member 103.

The wear and life detection system 102 includes a vibration sensor 111 and a tension member wear and life analysis unit 112. While one vibration sensor 111 is illustrated, any number of vibration sensors 111 may be included in the system 100. In one embodiment, the vibration sensor 111 measures a vibration of the tension member guiding element 104, as indicated by the dashed arrow extending from the tension member guiding element 104. In another embodiment, the sensor 111 measures the vibration of the tension member 103 directly. Such a sensor may be an optical sensor or position sensor, for example. Such a sensor is indicated by the dashed line extending directly from the tension member 103. In yet another embodiment, the sensor 111 measures the vibration of the elevator car 106, as indicated by the dashed line extending from the elevator car 111. In other words, embodiments of the invention encompass both embodiments in which the vibration of the tension member 103 are measured indirectly, via the tension member guiding element 104 or the elevator car 106, and embodiments in which the vibration of the tension member 103 is measured directly. Embodiments encompass sensors located directly on the elevator car 106, tension member 103, and tension member guiding element 104, as well as sensors located remotely from the elevator car 106, tension member 103, and tension member guiding element 104. Examples of sensors include accelerometers, velocity sensors, optical sensors, magnetic sensors, and any other sensor capable of measuring vibration, whether directly or remotely. For example, an optical sensor may be positioned remotely from the tension member 103 to measure the vibration of the tension member 103, while an accelerometer may be positioned directly on the elevator car 106 to measure the vibration of the elevator car 106.

The wear and life analysis unit 112 includes a spectral analysis unit 113, a frequency shift detection unit 114, and a threshold signal monitoring unit 115.

Referring to FIGS. 1 and 2, in block 201 of FIG. 2, a load on the tension member 103 is determined. In one embodiment, the vibration of the tension member 103 or elevator car 106 is measured when the elevator car 106 is known to be empty, and the load corresponds to the weight of the empty elevator car 106. In another embodiment, the elevator car 106 may have passengers or cargo, and the weight of the passengers or cargo may be measured to calculate the load. In block 202 of FIG. 2, the vibration sensor 111 detects the vibration of one or both of the tension member 103 and the elevator car 106. The vibration sensor 111 may detect the vibration of the tension member 103 directly via a sensor directed at the tension member 103 or located on the tension member 103, or the sensor may measure the vibration of the tension member 103 indirectly via on or more band guiding elements 104. Likewise, the sensor 111 may measure the vibration of the elevator car 106 directly via a sensor located on or directed at the elevator car 106, or indirectly via an element connected to the elevator car 106.

Measurements may be taken by the vibration sensor 111 during normal operation of the elevator system 100, or during controlled tests of the elevator system 100. For example, if passengers or cargo are being ferried by the elevator car 106, the weight of the passengers or cargo may affect the vibration frequency of the tension member 103. Accordingly, any analysis of the vibration of the tension member 103 or elevator car 106 by the wear and life analysis unit 112 would take into account the weight of the passengers or cargo in the elevator car 106. In one embodiment, measurement of the vibration of the tension member 103 or elevator car 106 includes running the elevator system 100 with no passengers in the elevator car 106 and measuring vibration. In one embodiment, a vibration is generated in the system by stopping the elevator car 106, then measuring the resulting vibration.

Figure 3:
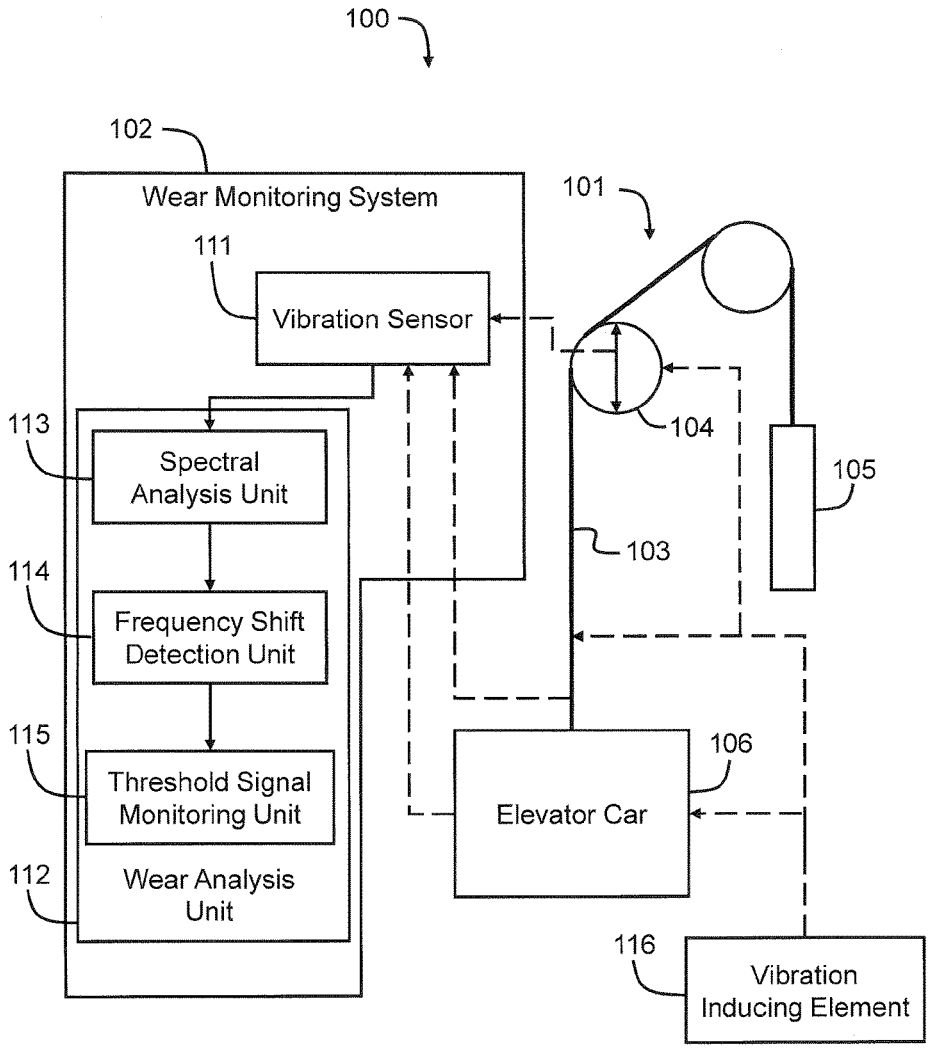
FIG. 3 illustrates an elevator system according to another embodiment of the invention.

In an alternate embodiment illustrated in FIG. 3, a vibration inducing element 116 may be applied to the tension member 103 or the elevator car 106 to produce a stimulus to the system which would produce car or tension member vibration responses. For example, this vibration inducing event could be a pre-programmed brake stop of the car at the lower landings during off-hour operation with no one in the car.

Figure 4A:
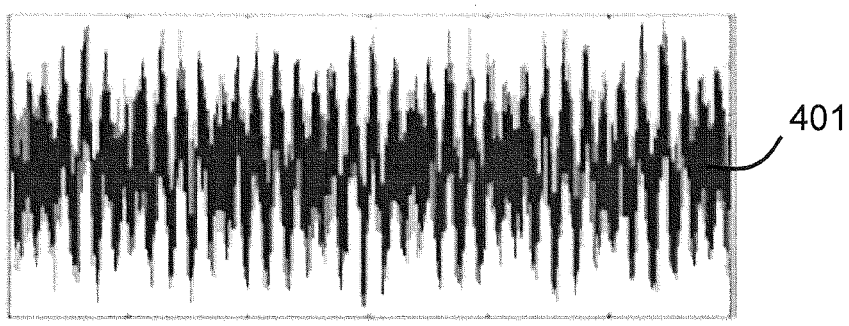
FIG. 4A illustrates a detected vibration according to an embodiment of the invention.

FIG. 4A illustrates an example of a waveform 401 of measured vibration of a tension member 103 according to one embodiment of the invention, where the horizontal axis corresponds to time and the vertical axis corresponds to magnitude. The vibration of the tension member 103 may be a relatively high-frequency vibration, such as in the range of hundreds of hertz or in the kilohertz range, while the vibration of the elevator car 106 may be in a low frequency range, such as in the single digits of hertz, or the tens of hertz.

Figure 4B:
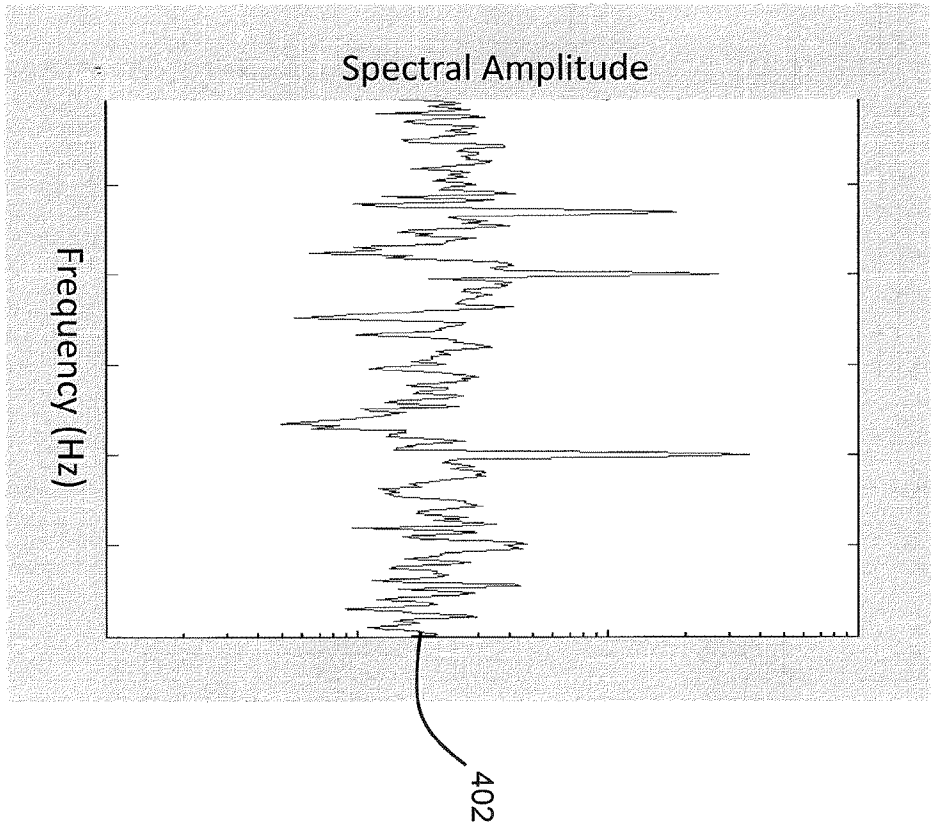
FIG. 4B illustrates a spectrum analysis of the detected vibration according to an embodiment of the invention.

Referring again to FIGS. 1 and 2, in block 205, a spectral analysis unit 113 may perform a spectral analysis 113 of the vibration measurement to determine the frequencies at which the tension member 103 or elevator car 106 are vibrating. The spectral analysis unit 113 includes any memory, processor, logic, and software for controlling the processor, capable of receiving signals having particular frequency information, and generating a spectrum based on the received signals to represent frequency information of the received signals. FIG. 4B illustrates an example of a spectrum 402 resulting from a spectral analysis of the waveform 401 of FIG. 4A. In FIG. 4B, the horizontal axis corresponds to frequency, and the vertical axis corresponds to magnitude.

Figure 5A:
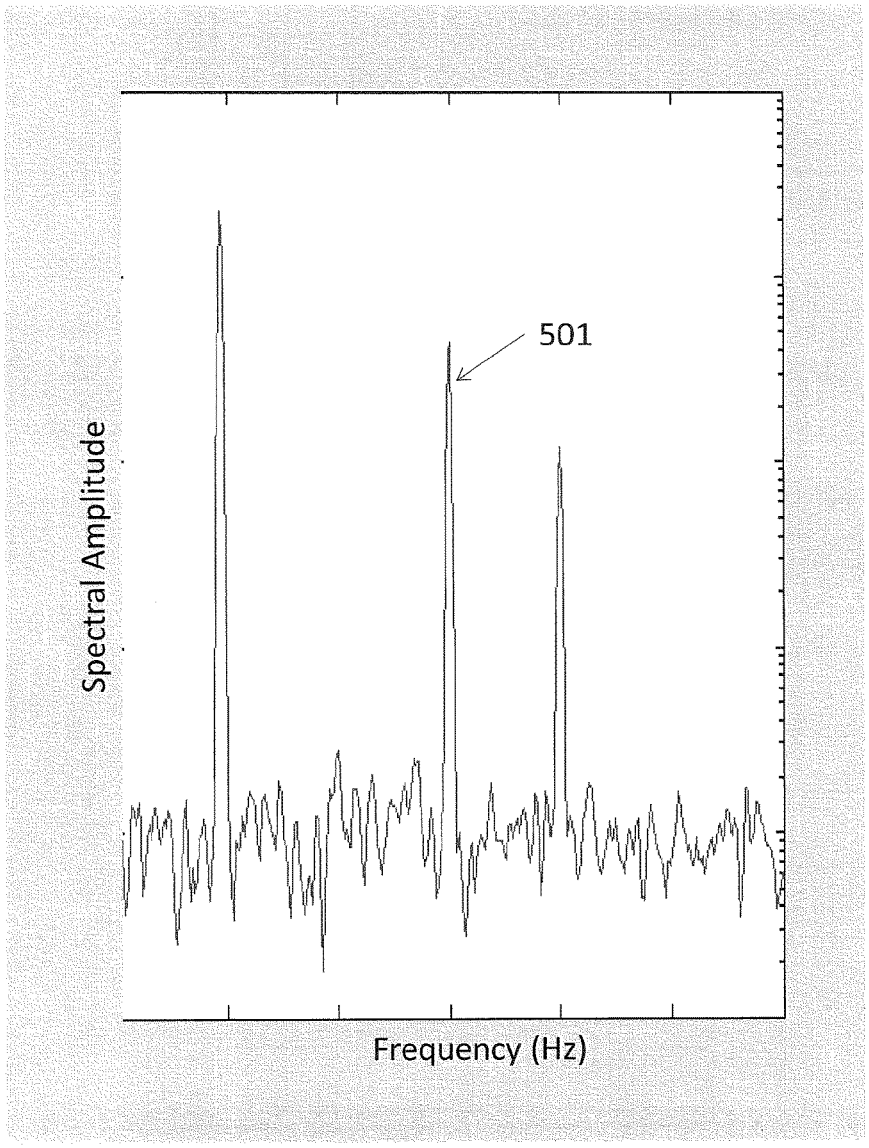
FIG. 5A illustrates another spectrum analysis according to an embodiment of the invention.
Figure 5B:
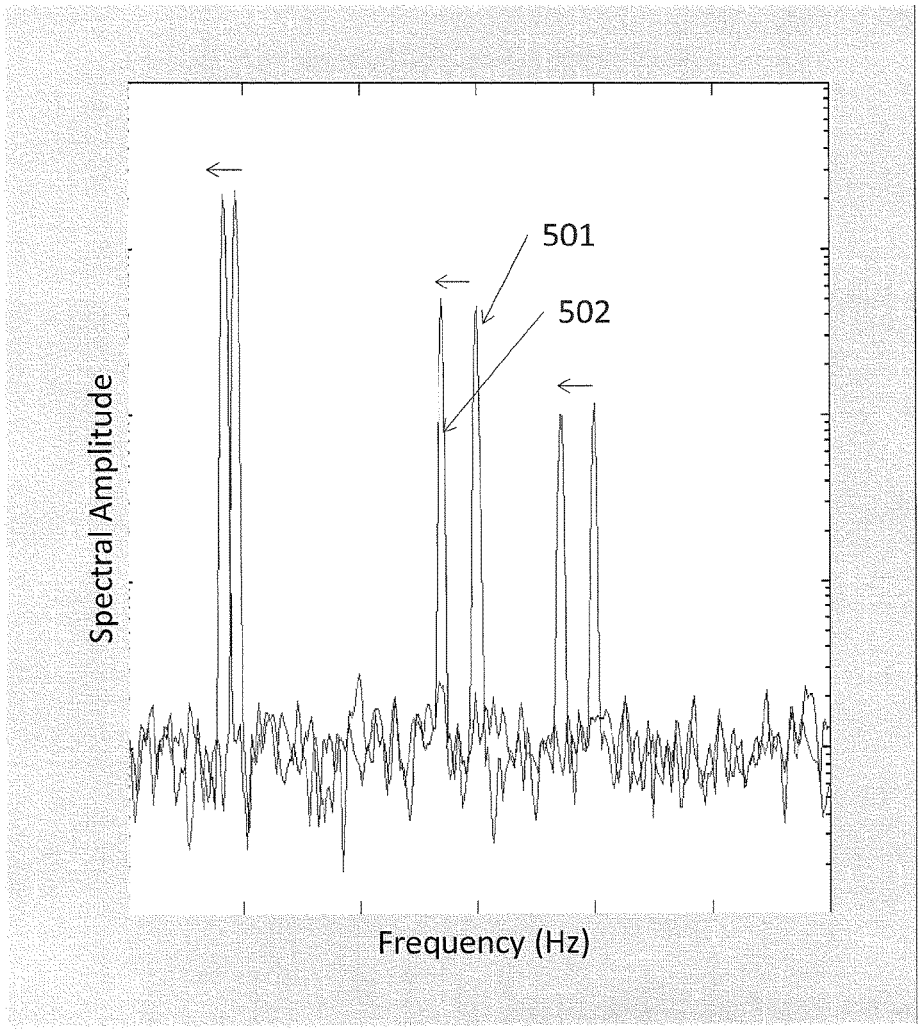
FIG. 5B depicts a phase shift according to an embodiment of the invention.

In block 206 of FIG. 2, the frequency shift detection unit 114 may analyze the spectrum generated by the spectral analysis, and may determine a shift in frequency relative to a reference spectrum, such as a spectrum obtained from previous vibration measurements, or any other predefined spectrum. The frequency shift detection unit 114 may include any memory for storing predefined, or previously measured spectra from spectral analyses, and any other processor, logic and other circuitry for detecting a frequency shift in the spectra. FIG. 5A illustrates a reference spectrum 501 generated by a spectral analysis at a first time, and FIG. 5B illustrates a frequency shift to a second spectrum 502. Such a frequency shift may indicate wear and life of the tension member 103, for example.

In block 203 of FIG. 2, the wear and life of the tension member 103 is determined based on the vibration detected in block 202. For example, the wear and life of the tension member 103 may be determined based on the frequency shift detected by the frequency shift detection unit 114 in block 206 of FIG. 2.

In an embodiment in which the primary vibration of the elevator car 106 is measured, the frequency of the measured vibration corresponds to the properties of the tension member 103 according to the following equations:

$$K_{tension\ member}=nEA/L, \text{ and} \tag{1}$$

$$f_{car}=(1/2\pi)*\sqrt{(K_{tension\ member}/M)} \tag{2}$$

In the above equation (1), K represents a frequency shift of the tension member 103, n represents the number of tension members that make up the elevator system 100 (the tension member 103 may include only one tension member or multiple tension members), E represents the elastic modulus of the tension member 103, A represents the cross-sectional area of the tension member 103, and L represents the tension member length. In equation (2), $f_{car}$ is a vibration frequency of the elevator car 106 and M is the mass of the elevator car 106. According to the above equations (1) and (2), a shift in the frequency at which the elevator car 106 vibrates is related to the modulus of elasticity E of the tension member 103, the length of the tension members, and the mass of the elevator car with its contained payload. This information can be used to predict the changes in the tension member's modulus of elasticity which can be further correlated to the effective level of wear and life of the tension member 103.

In an embodiment in which the vibration of the tension member 103 is measured, the relationship between the measured longitudinal vibration frequency of the tension member 103 and the properties of the tension member 103 are represented by the following equations:

$$V=E/rho \tag{3}$$

$$f_{long}=V/L \tag{4}$$

In the above equation (3), V is a wave speed and rho is the tension member density. In the above equation 4, $f_{long}$ is a primary longitudinal frequency along the tension member 103. There can be tension member frequencies that are higher order harmonics of the primary longitudinal frequency. According to the above equations (3) and (4), a shift in the frequency at which the tension member 103 vibrates is related to the modulus of elasticity E of the tension member 103, which can be used to measure the level of wear and life of the tension member 103.

Referring again to FIGS. 1 and 2, if it is determined by a threshold signal monitoring unit 115 that a tension member 103 is worn beyond a predetermined threshold, such as by determining that a detected frequency shift exceeds a predetermined frequency shift, corrective action may be taken. For example, the wear and life monitoring system 102 may generate a notice or warning regarding wear and life levels, a notice to replace a tension member 103 may be generated, and the tension member 103 may be replaced or additional inspection of the tension member 103 may be performed.

Technical effects of embodiments of the invention include the detection of wear and life of a tension member, rope, or cable bearing a load. Such detection may be performed without manual inspection by vibration sensors. Such detection may further be performed during operation of an elevator system, or during a time period in which the system is not in normal use, without interrupting normal service by the elevator system during peak use hours.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator system, comprising:

an elevator drive system including a tension member supporting an elevator car under tension; and a wear and life monitoring system comprising a vibration sensor for detecting vibration of one or more tension member guiding elements, and a wear and life analysis unit for determining a level of wear and life of the tension member based on the vibration detected by the vibration sensor;

wherein the wear and life analysis unit determines the level of wear and life of the tension member based on the vibration of the one or more tension member guiding elements.

2. The elevator system of claim 1, wherein the vibration sensor includes an accelerometer connected to the one or more tension member-guiding elements for detecting the vibration of the one or more tension member-guiding elements.

3. The elevator system of claim 1, wherein the vibration sensor is configured to detect a longitudinal vibration of the tension member.

4. The elevator system of claim 1, wherein the wear and life analysis unit is configured to determine the level of wear and life of the tension member by performing a spectral analysis of the vibration detected and measuring a level of frequency shift of the detected vibration relative to a reference frequency spectrum.

5. The elevator system of claim 1, wherein the wear and life analysis unit is configured to determine the level of wear and life of the tension member by determining an elastic modulus of the tension member.

6. The elevator system of claim 1, further comprising a vibration inducing element to create the vibration of at least one of the tension member and the elevator car.

7. A method of determining a level of wear and life of a tension member supporting a load, the method comprising:

detecting a vibration of one or more tension member guiding elements; and determining a level of wear and life of the tension member based on the detected vibration;

wherein determining the level of wear and life of the tension member based on the detected vibration includes determining the level of wear and life of the tension member based on the vibration of the one or more tension member guiding elements.

8. The method of claim 7, wherein determining the level of wear and life of the tension member includes determining the modulus of elasticity of the tension member based on the detected vibration.

9. The method of claim 7, wherein detecting the vibration of the one or more tension member guiding elements includes detecting a longitudinal vibration of the tension member.

10. The method of claim 7, wherein determining the level of wear and life of the tension member based on the detected vibration includes performing a spectral analysis of the vibration detected and measuring a level of frequency shift of the detected vibration relative to a reference frequency spectrum.

11. A tension member wear and life monitoring system, comprising:

one or more sensors to detect a vibration of one or more tension member guiding elements; and a wear and life analysis unit for determining a level of wear and life of the tension member based on the vibration of the one or more tension member guiding elements.

12. The tension member wear and life detection system of claim 11, wherein the wear and life analysis unit is configured to determine the level of wear and life of the tension member by determining an elastic modulus of the tension member.

* * * * *